US007395940B2

(12) United States Patent
Abel et al.

(10) Patent No.: US 7,395,940 B2
(45) Date of Patent: Jul. 8, 2008

(54) METHOD OF OPERATING A CRANE

(75) Inventors: Peter Abel, Mengen (DE); Helmut Spaeth, Schelklingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 4 days.

(21) Appl. No.: 11/494,777

(22) Filed: Jul. 26, 2006

(65) Prior Publication Data

US 2007/0023377 A1 Feb. 1, 2007

(30) Foreign Application Priority Data

Jul. 29, 2005 (DE) ..... 10 2005 035 729

(51) Int. Cl.
*B66C 13/06* (2006.01)

(52) U.S. Cl. ..... 212/270; 212/272; 212/275

(58) Field of Classification Search ..... 212/272, 212/273, 275, 270

See application file for complete search history.

(56) References Cited

U.S. PATENT DOCUMENTS 3,035,712 A * 5/1962 Nowack ..... 212/278

FOREIGN PATENT DOCUMENTS

| | | |
|---|---|---|
| DE | 19653579 | 6/1998 |
| DE | 19933917 | 2/2000 |
| DE | 10115312 | 10/2002 |

* cited by examiner

*Primary Examiner*—Thomas J. Brahan
(74) *Attorney, Agent, or Firm*—Alleman Hall McCoy Russell & Tuttle LLP

(57) ABSTRACT

The present disclosure relates to a method of operating a crane whose safe working load depends on one or more changeable parameters, with the change of at least one of the parameters being made such that the speed of the parameter change is reduced continuously or step-wise before a parameter value is reached at which the safe working load corresponds to the actual working load.

20 Claims, 1 Drawing Sheet

METHOD OF OPERATING A CRANE

CROSS-REFERENCE TO RELATED APPLICATION

This application claims priority to German Patent Application Serial No. 10 2005 035 729.6 filed Jul. 29, 2005, which is hereby incorporated by reference in its entirety for all purposes.

FIELD

The present disclosure relates to a method of operating a crane whose permitted or safe working load depends on one or more changeable parameters.

BACKGROUND AND SUMMARY

The dependency of the working load on different set-up or state parameters of cranes is usually shown in the form of so-called working load tables. The safe working load is shown in these, for example, in dependence on the parameters of radius and boom length. With larger radii and boom lengths, lower values result for the safe working load than with values lower in comparison with them. Working load tables with other parameters which have an influence on the safe working load are naturally also conceivable.

Cranes known today are operated such that the parameters are changed so much until the safe working load corresponds to the actual working load. As soon as this limit value has been reached, a further parameter change is suppressed, with the braking of the corresponding crane movement or of the movement of a crane component taking place abruptly. This has the result, on the one hand, that the load starts to swing and, on the other hand, that the drive components and the steel construction are exposed to substantial loads due to the abrupt stopping of the movement.

It is the object of the present disclosure to further develop a method of operating a crane such that the loads on the drive components and on the steel construction in the operation of the crane are reduced and the swinging of any load is prevented or is likewise reduced.

This object is solved by a crane whose safe working load depends on one or more changeable parameters, wherein the change of at least one of the parameters is made such that the speed of the parameter change is reduced continuously or step-wise before a parameter value is reached at which the safe working load corresponds to the actual working load. No abrupt or jolting stopping from a full adjustment speed therefore takes place, but a continuous or step-wise braking, i.e. the speed of the movement of the crane or of the crane component is reduced continuously or step-wise. This brings along the advantage that the swinging of any load can be prevented or at least reduced with respect to previously known methods and that the components of the crane such as the drive components or bearing components such as the steel construction may be less strained.

The reduction can take place continuously or also step-wise. The reduction in the speed can e.g. take place such that it is reduced on or before the reaching of the coincidence between the safe and the actual working load from a value reduced with respect to the other change speed in a stepped manner to zero or that the value of zero is achieved by a continuous reduction of the speed.

The method in accordance with the present disclosure can be used when the actual working load is zero or greater than zero. The parameters of the crane, such as the boom length, can also not be varied as desired without a working load. At the margin of the working load tables, the value zero results for the safe working load. If the crane approaches this table margin with respect to its parameters of relevance here, provision is made in accordance with the present disclosure for this approach to take place with continuously reduced or step-wise reduced speed. A corresponding procedure results when the actual working load is larger than zero and the safe working load is changed by a parameter change.

The parameter(s) to which the method in accordance with the present disclosure is applied can be many, such as a parameter relating to a position of the crane or of a crane component.

The parameter can also be the boom length, the boom angle, the derrick ballast radius and/or the angle of rotation of the slewing platform. As stated, these are examples; other parameters are naturally also conceivable.

Provision can be made for the speed of the parameter change to be reduced continuously or step-wise starting when a difference between the actual and the safe working load falls below a given amount, i.e. over a specific residual path.

This difference can adopt a constant value or a value which depends on the actual and/or safe working load or its difference or the ratio of this difference to the actual and/or safe working load.

Provision can be made for the speed of the parameter change to be reduced such that the speed of the parameter change adopts the value zero, i.e. the parameter value is no longer changed or is reduced to a specific value when the safe working load corresponds to the actual working load or exceeds it slightly. In this connection, the speed of the parameter change can be reduced from a reduced speed to zero or to the specific value in a further step or the speed of the parameter change can be reduced such that the value zero or the specific value is reached continuously, e.g. in a linear or asymptotic manner.

It is particularly advantageous if the change of the parameter(s) is made such that the actual working load cannot exceed the safe working load.

The present disclosure furthermore relates to a crane having means which controls the crane in accordance with one or more of the various methods described herein. It can, for example, be a derrick crane or a mobile crane. Other crane types are also feasible.

DETAILED DESCRIPTION

Figure 1:
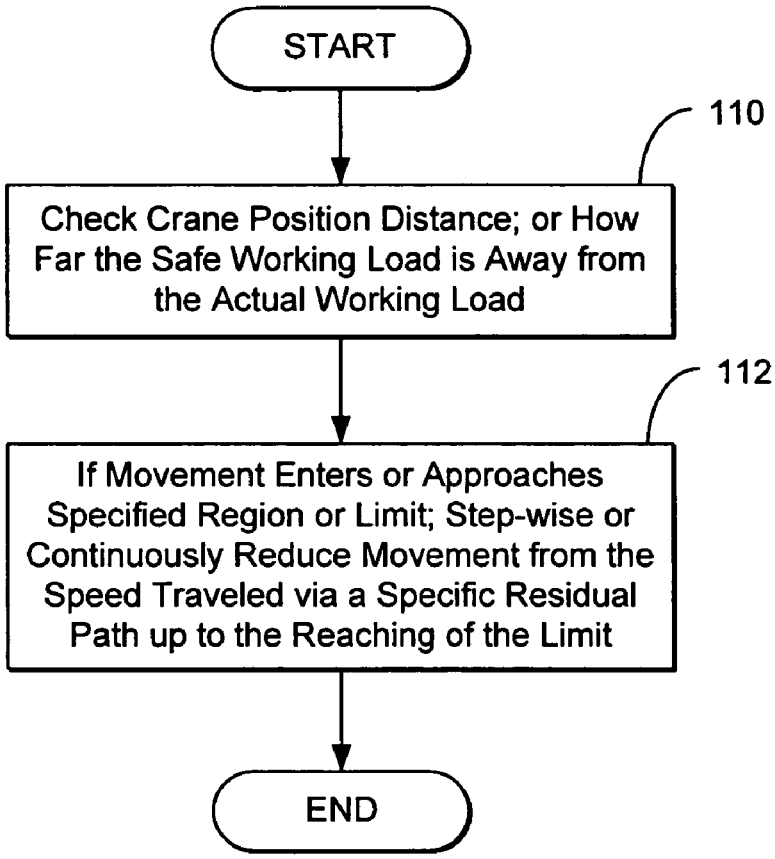
FIG. 1 shows an example high level flowchart of an example method of operating a crane.

Further details and advantages of the present disclosure will be explained in more detail with reference to an embodiment shown in the following.

start

Block 110—check crane position distance; or how far the safe working load is away from the actual working load Block 112—If movement enters or approaches specified region or limit; step-wise or continuously reduce movement from the speed traveled via a specific residual path up to the reaching of the limit End The crane in accordance with the following embodiment is operated such that at 110 a check is made continuously without a working load in operation or as required or depending on the instantaneously carried out crane movement as to how far the current crane position is away from the crane position at which the working load changes from >0 t to 0 t, i.e. at which the working load table margin is reached. The same applies accordingly on operation with a working load with respect to the check as to how far the safe working load is away from the actual working load.

In 112, if the crane moves from the working range with a working load >0 into the proximity of a region with a working load=0 t, i.e. in the proximity of the table margin, or if the safe working load approaches the actual working load due to a crane movement, i.e. due to a movement of a crane component e.g. to adjust the load or to change the load bearing capacity or the crane position, for example on luffing or telescoping the boom, on pushing out the derrick ballast or on rotating the slewing platform, the crane movement which moves the crane in the direction toward the named limit values is reduced from the speed traveled up to then (luffing speed, telescoping speed, speed of the pushing out of the derrick ballast, rotating speed) via a specific residual path up to the reaching of the limit.

This reduction can take place step-wise or continuously or also regionally step-wise and regionally continuously.

Although the present disclosure does not preclude the exceeding of the named limits, provision is preferably made for the limit value not to be exceeded, i.e. for the speed of the parameter change to be reduced to the value zero before or on the reaching of the limit value.

The advantage results from this that the speed is not reduced from the full amount to zero abruptly, but a continuous or step-wise reduction rather takes place. This brings along the advantage that any load does not start swinging or only starts to swing relatively little and drive components and the steel construction are saved since strain peaks are avoided.

To have a working range available which is as large as possible, the crane should be moved as close as possible to the limit value which results from the working load value zero or from the actual working load value.

Provision is preferably made for the range outside the named limit value not to be able to be moved to in normal crane operation, i.e. for it not to be possible to move over the limit, because moving back out of this range lying outside the limits into the range lying inside the limits is not possible without any bridging measure since the making of crane movements to the limit values or outside the limit values is dangerous as a rule.

A bridging option (mounting switch) could thereby largely be dispensed with in normal crane operation.

Figure 2:
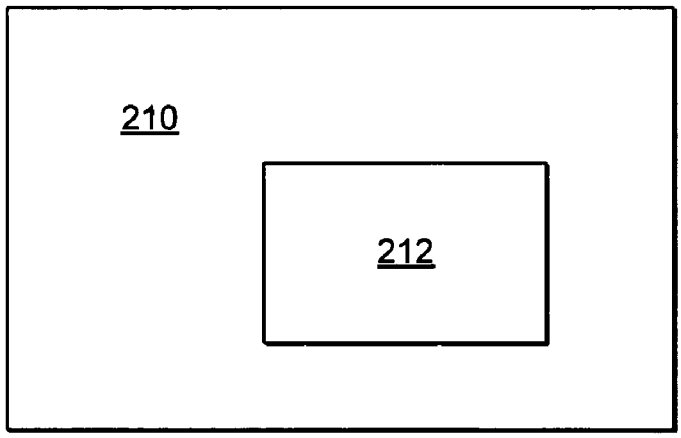
FIG. 2 shows an example crane system

FIG. 2 shows an example crane system 210 having a means 212, which may be a control system, computer readable storage device, or other controller which controls the crane in accordance with one or more of the various methods described herein.

The invention claimed is:

1. A method of operating a crane whose safe working load depends on one or more changeable parameters, comprising:

changing at least one of the parameters such that a speed of the parameter change is reduced continuously or step-wise and not abruptly, by reducing the speed of the movement of the crane or of a crane component continuously or step-wise, before a parameter value is reached at which the safe working load corresponds to an actual working load.

2. The method according to claim 1, wherein the actual working load is zero or larger than zero.

3. The method according to claim 1, wherein the parameter is a parameter relating to the position of the crane or of a crane component.

4. The method according to claim 1, wherein the parameter is a boom length, a boom angle, a derrick ballast radius and/or an angle of rotation of a slewing platform.

5. The method according to claim 1, wherein the speed of the parameter change is reduced continuously or step-wise starting when a difference between the actual working load and the safe working load falls below a threshold amount.

6. The method according to claim 5, wherein the difference adopts a constant value.

7. The method according to claim 5, wherein the difference adopts a value which depends on a ratio of the difference to the actual and/or safe working load.

8. The method according to claim 1, wherein the speed of the parameter change is reduced to the value zero via the continuous or step-wise reduction.

9. The method according to claim 8 wherein the parameter value is no longer changed or is reduced to a specific value when the safe working load corresponds to the actual working load or exceeds it.

10. The method according to claim 9, wherein the speed of the parameter change is first reduced via the continuous or step-wise reduction to a first reduced speed, and then further reduced to zero or to the specific value in one step.

11. The method according to claim 9 wherein the speed of the parameter change is reduced such that the value zero or the specific value is reached continuously.

12. The method according to claim 1, wherein the change of the parameter is made such that the actual working load cannot exceed the safe working load.

13. A method of operating a crane whose safe working load depends on one or more changeable parameters, comprising:

when an actual working load exceeds the variable safe working load, changing at least one of the parameters during crane operation to bring the actual working load to the safe working load;

continuously or step-wise reducing a speed of the parameter change and not abruptly, by reducing the speed of the movement of the crane or of a crane component continuously or step-wise, before a parameter value is reached at which the safe working load corresponds to the actual working load; and reaching the safe working load with the crane in a substantially non-oscillatory condition.

14. The method according to claim 13, wherein the actual working load is zero or larger than zero.

15. The method according to claim 14, wherein the parameter is a parameter relating to the position of the crane or of a crane component.

16. The method according to claim 14, wherein the parameter includes at least one of a boom length, a boom angle, a derrick ballast radius and/or an angle of rotation of a slewing platform.

17. The method according to claim 16, wherein the speed of the parameter change is reduced continuously or step-wise based on a difference between the actual working load and the safe working load.

18. The method according to claim 17 further comprising discontinuing the change of the parameter value or reducing the change to a specific value when the safe working load corresponds to the actual working load or exceeds it.

19. A system, comprising:

a crane whose safe working load depends on one or more changeable parameters;

a control system for operating the crane, changing at least one of the parameters during crane operation, and continuously or step-wise reducing a speed of the parameter change and not abruptly, by reducing the speed of the movement of the crane or of a crane component continuously or step-wise, before a parameter value is reached at which the safe working load corresponds to an actual working load, where the speed of the parameter change is reduced continuously or step-wise based on a difference between the actual working load and the safe working load, and the change of the parameter is made such that the actual working load cannot exceed the safe working load.

20. The system of claim 19 wherein said control system further discontinues the change of the parameter value or reduces the change to a specific value when the safe working load corresponds to the actual working load or exceeds it, and where the speed of the parameter change is reduced such that the value zero or the specific value is reached continuously.

* * * * *